US009532660B2

(12) United States Patent
Jafa et al.

(10) Patent No.: US 9,532,660 B2
(45) Date of Patent: Jan. 3, 2017

(54) REFRIGERATED MERCHANDISE DISPLAY SYSTEM

(75) Inventors: Emad Jafa, Brewster, NY (US); Antonio Jose Fernandes Ribeiro, Deerfield Beach, FL (US); José Roberto Montero, Satelite (MX); Jose Miguel Gutierrez, Danbury, CT (US); Jose Alfonso Gonzalez Santamaria, La Libertad (SV); Edith Nancy Treviño Garcia, San Pedro Garza García N.L. (MX); Rodrigo Guadarrama, Metepec (MX); César Eduardo Avendaño Acero, Aguascalientes (MX); Dimas Alberto Diaz Zaleta, Reynosa Tamaulipas (MX)

(73) Assignee: PEPSICO, INC., Purchase, NY (US)

( * ) Notice: Subject to any disclaimer, the term of this patent is extended or adjusted under 35 U.S.C. 154(b) by 195 days.

(21) Appl. No.: 13/173,342

(22) Filed: Jun. 30, 2011

(65) Prior Publication Data

US 2013/0000343 A1 Jan. 3, 2013

(51) Int. Cl.
*A47F 3/04* (2006.01)
*F25D 23/06* (2006.01)

(52) U.S. Cl.
CPC ..... *A47F 3/0404* (2013.01); *F25D 23/062* (2013.01); *F25D 2400/14* (2013.01)

(58) Field of Classification Search
CPC ..... A47F 3/0434; A47F 3/001; A47F 3/0404; A47F 3/04; A47F 3/005; F25D 23/006; F25D 23/003; F25D 19/02; F25D 19/00; F25D 19/003; F25D 23/061; F25D 23/067; A47B 47/0083; A47B 47/05; A47B 47/03; H02B 1/301
(Continued)

(56) References Cited

U.S. PATENT DOCUMENTS 1,321,097 A 11/1919 Gonzalez
1,390,812 A * 9/1921 Ottenheimer ..... A47F 3/0421 312/116

(Continued)

FOREIGN PATENT DOCUMENTS

DE 2 674 112 A1 9/1992
DE 29813445 U1 1/1999

(Continued)

OTHER PUBLICATIONS

Machine Translation of German Patent Document 202006015119 U1—Translated Jun. 2013.*

(Continued)

*Primary Examiner* — Len Tran
*Assistant Examiner* — Kirstin Oswald
(74) *Attorney, Agent, or Firm* — Sterne, Kessler, Goldstein & Fox P.L.L.C.

(57) ABSTRACT

A refrigerated merchandise display system for storing and dispensing merchandise. The merchandise display system includes an outer housing, an inner support, a transparent front door, a refrigeration unit, a front door assembly, and a plurality of windows. The merchandise display system further includes a plurality of shelves for supporting merchandise within the display system. The refrigeration unit may be positioned at the top of the merchandise display system and may be removable. The outer housing of the refrigeration unit may be manufactured in a variety of colors. Each of the colors may be indicative a type of merchandise stored within the merchandise display system.

20 Claims, 7 Drawing Sheets

(58) Field of Classification Search
USPC ..... 62/246, 249, 251, 443, 446, 448, 445,62/298, 302; 312/116, 117, 36, 223.5, 401, 312/404
See application file for complete search history.

(56) References Cited

U.S. PATENT DOCUMENTS 1,926,384 A * 9/1933 Hull ..... F25D 11/025 62/237
1,971,002 A * 8/1934 Gray ..... 220/592.09
2,030,554 A * 2/1936 Van Sciver ..... F25D 19/02 62/296
2,161,852 A * 6/1939 Collins ..... F25D 23/062 220/592.09
2,418,062 A * 3/1947 Abrahamson ..... A47F 3/0486 312/125
2,429,294 A 10/1947 Pollock
2,466,159 A * 4/1949 Dodson ..... G07F 11/54 194/239
2,554,610 A 5/1951 Benson
2,693,989 A * 11/1954 Santana ..... A47B 49/004 211/131.1
3,156,102 A 11/1964 Costantini et al.
3,252,258 A 5/1966 Blickman et al.
3,490,598 A * 1/1970 Federman ..... A47F 5/0031 108/5
3,598,464 A * 8/1971 Moroziuk ..... E06B 3/4663 312/217
3,655,939 A * 4/1972 Stromquist ..... H05B 3/84 219/218
3,656,248 A 4/1972 Echter
3,712,078 A * 1/1973 Maynard ..... F25D 19/00 165/76
3,948,410 A 4/1976 Anderson
3,995,922 A * 12/1976 Ohashi ..... F25D 23/063 312/236
4,072,486 A * 2/1978 Joseph ..... A47F 3/043 62/131
4,135,369 A * 1/1979 Allgeyer ..... A47F 3/04 62/251
4,243,145 A * 1/1981 Woodhead ..... A47F 7/17 211/189
4,270,819 A * 6/1981 Ooho ..... A47F 3/04 312/116
4,320,933 A * 3/1982 Felix ..... G07F 9/10 312/204
4,369,631 A * 1/1983 Abraham ..... F25D 21/125 62/255
4,592,209 A 6/1986 Casanova et al.
4,753,043 A * 6/1988 Bockwinkel ..... A47F 3/043 49/501
4,883,001 A 11/1989 Roth
4,920,764 A * 5/1990 Martin ..... 62/259.1
4,973,109 A 11/1990 Diedrich
5,105,978 A * 4/1992 Trouteaud ..... G07F 9/02 221/150 R
5,255,968 A 10/1993 Craven
5,284,023 A * 2/1994 Silva ..... F25D 19/02 312/236
5,397,005 A * 3/1995 Taccolini ..... A47F 7/0021 211/163
5,399,005 A 3/1995 Schafer
5,402,654 A 4/1995 Rudick et al.
5,417,079 A * 5/1995 Rudick ..... A47F 3/0408 62/237
5,417,081 A 5/1995 Rudick et al.
5,458,407 A * 10/1995 Bustos ..... A47F 3/0408 312/116
5,475,987 A * 12/1995 McGovern ..... A47F 3/0447 62/256
5,549,373 A * 8/1996 Bustos ..... 312/135
5,553,934 A 9/1996 Wells et al.
5,622,059 A 4/1997 McClellan
5,688,031 A 11/1997 Tryon
5,688,032 A 11/1997 Tryon
5,690,400 A 11/1997 Tryon
5,720,535 A * 2/1998 Mehman ..... E05B 65/462 312/218
5,758,512 A * 6/1998 Peterson ..... F25D 17/065 62/407
D404,935 S 2/1999 Shappell
5,996,366 A 12/1999 Renard
D421,534 S 3/2000 Trulaske, Sr. et al.
6,094,934 A * 8/2000 Rand et al. ..... 62/440
6,098,529 A 8/2000 Brummett et al.
6,109,053 A * 8/2000 Strackbein ..... H02B 1/30 62/259.1
6,145,672 A * 11/2000 Bachman et al. ..... 211/13.1
6,148,563 A * 11/2000 Roche ..... A47F 3/0434 49/501
6,196,001 B1 3/2001 Tannous et al.
6,230,930 B1 * 5/2001 Sorensen ..... G07F 11/16 221/131
6,328,180 B1 * 12/2001 Sorensen ..... G07F 11/16 221/131
6,406,108 B1 6/2002 Upton et al.
6,415,623 B1 7/2002 Jennings et al.
6,488,172 B1 * 12/2002 Wenning ..... F25D 23/062 220/592.02
6,513,677 B1 * 2/2003 Sorensen et al. ..... 221/130
6,539,740 B1 4/2003 Santana, Jr.
6,550,269 B2 4/2003 Rudick
6,571,571 B2 6/2003 Playford
6,640,581 B1 11/2003 Choi
6,701,739 B2 3/2004 Morse
6,948,324 B2 9/2005 Jin
D513,014 S 12/2005 Seki
D514,137 S 1/2006 Seki
7,032,400 B2 4/2006 Roche et al.
7,047,755 B2 * 5/2006 Upton ..... A47F 3/0408 165/150
7,065,977 B2 * 6/2006 Upton ..... A47F 3/0408 165/177
D524,830 S 7/2006 Lei et al.
7,162,885 B2 1/2007 Sakanoue et al.
D541,315 S 4/2007 Trulaske, Sr.
7,251,954 B2 8/2007 Fee et al.
7,360,374 B2 * 4/2008 LaRose, Jr. ..... A47F 3/0434 359/361
7,367,685 B2 * 5/2008 Moll ..... A47B 97/00 312/223.5
7,431,409 B2 10/2008 Yang
7,448,225 B2 * 11/2008 Iguchi ..... F25D 19/02 62/255
7,451,614 B2 * 11/2008 Luehrs ..... F25D 11/02 62/441
D589,986 S 4/2009 Rogers et al.
7,574,869 B2 8/2009 Shapiro
7,703,295 B2 4/2010 Zangari et al.
D625,125 S * 10/2010 Buckles ..... D15/81
7,874,168 B2 * 1/2011 Cohen et al. ..... 62/77
7,905,370 B2 3/2011 Leonetti
7,997,094 B2 * 8/2011 Zangari ..... A47F 3/0408 62/129
8,021,009 B2 * 9/2011 Knoll ..... A47F 3/001 362/602
8,024,907 B2 * 9/2011 McKinlay ..... E06B 3/22 49/504
D647,113 S * 10/2011 Howell ..... D15/81
8,317,349 B2 * 11/2012 Hernandez ..... A47F 3/001 362/217.02
D675,846 S * 2/2013 Monaldi ..... D6/661
8,393,130 B2 * 3/2013 Stubblefield ..... A47F 3/0434 52/204.593
8,424,332 B2 * 4/2013 Yamasaki ..... F25D 23/006 62/255
2002/0020184 A1 2/2002 Playford
2002/0056287 A1 5/2002 Rudick
2002/0078654 A1 * 6/2002 Richardson ..... A47F 3/0434 52/656.9

(56) References Cited

U.S. PATENT DOCUMENTS

2003/0084827 A1* 5/2003 Nicholson ..... A47F 1/12 108/106
2003/0172670 A1* 9/2003 Vormedal ..... A47F 3/0447 62/407
2003/0213259 A1* 11/2003 Upton ..... A47F 3/0408 62/246
2003/0230095 A1* 12/2003 Kahler ..... A47F 3/0486 62/155
2003/0230104 A1 12/2003 Morse
2003/0233841 A1* 12/2003 Yingst ..... A47F 3/0413 62/246
2004/0035142 A1 2/2004 Yoon et al.
2004/0134221 A1 7/2004 Fee et al.
2004/0139763 A1 7/2004 Jeong et al.
2004/0221600 A1 11/2004 Flum
2004/0226309 A1 11/2004 Broussard
2004/0245900 A1 12/2004 Parkkinen
2005/0102918 A1* 5/2005 Richardson ..... A47F 3/004 52/79.1
2005/0109040 A1 5/2005 Hansen
2005/0115261 A1 6/2005 Sakanoue et al.
2005/0172654 A1 8/2005 Rohrer et al.
2005/0173362 A1* 8/2005 Squitieri ..... A47F 9/00 211/187
2005/0210904 A1 9/2005 Roche et al.
2005/0262863 A1 12/2005 Iguchi et al.
2006/0117789 A1 6/2006 Yamasaki et al.
2006/0196208 A1 9/2006 Zangari et al.
2006/0207276 A1 9/2006 Daddis, Jr. et al.
2007/0003700 A1* 1/2007 Roche ..... A47F 3/0434 427/372.2
2007/0089453 A1 4/2007 Shapiro
2007/0089454 A1 4/2007 Shapiro
2007/0193280 A1 8/2007 Tuskiewicz et al.
2007/0216270 A1* 9/2007 Betto ..... F25D 23/063 312/404
2007/0241645 A1 10/2007 Trulaske, Sr.
2008/0036349 A1* 2/2008 Crompton ..... F25D 23/062 312/401
2008/0098761 A1* 5/2008 Zangari ..... A47F 3/0408 62/249
2008/0148753 A1 6/2008 Welker et al.
2008/0148765 A1 6/2008 Barone et al.
2008/0158858 A1* 7/2008 Madireddi ..... A47F 3/001 362/92
2008/0167106 A1* 7/2008 Lutnick et al. ..... 463/16
2008/0184715 A1* 8/2008 Chen ..... F25B 47/022 62/81
2008/0252184 A1 10/2008 Decker et al.
2008/0277361 A1* 11/2008 Primiano ..... A47F 3/001 211/49.1
2008/0307815 A1* 12/2008 Daddis, Jr. ..... A47F 3/0482 62/246
2009/0000316 A1* 1/2009 Cohen et al. ..... 62/77
2009/0021125 A1 1/2009 Weiss
2009/0045712 A1 2/2009 Laible
2009/0072679 A1* 3/2009 Avila ..... E06B 3/025 312/116
2009/0151385 A1 6/2009 Hagele et al.
2009/0165488 A1 7/2009 Chen
2009/0183515 A1* 7/2009 Hale ..... A47F 3/063 62/62
2009/0272136 A1* 11/2009 Knoll ..... A47F 3/001 62/251
2009/0314028 A1 12/2009 Laible
2010/0018232 A1* 1/2010 Bratton ..... A47F 3/001 62/246
2010/0018233 A1* 1/2010 Jafa ..... A47F 3/0482 62/249
2010/0058786 A1* 3/2010 Iguchi ..... A47F 3/0482 62/246
2010/0068398 A1* 3/2010 Roche ..... A47F 3/0434 427/384
2010/0077780 A1* 4/2010 Wenzel ..... A47F 3/0452 62/246
2010/0095687 A2 4/2010 Tuszkiewicz et al.
2010/0097780 A1* 4/2010 Beatenbough ..... A47F 3/001 362/92
2010/0145507 A1* 6/2010 Blust et al. ..... 700/232
2010/0180615 A1 7/2010 Linder et al.
2010/0205992 A1* 8/2010 Morris ..... F25D 25/025 62/246
2011/0100044 A1* 5/2011 Reichert ..... A47F 3/0434 62/246
2013/0264353 A1* 10/2013 Milan ..... G07F 11/08 221/9

FOREIGN PATENT DOCUMENTS

DE 202006015119 U1 12/2006
FR 2812078 A3 * 1/2002 ..... A47B 47/00
GB 1467636 A * 3/1977 ..... F25D 23/062
GB 2198030 A * 6/1988 ..... A47F 3/0439
JP 2005-180790 A 7/2005
WO 9401025 A1 1/1994
WO 2006137422 A1 12/2006

OTHER PUBLICATIONS

International Search Report & Written Opinion mailed Jun. 19, 2012 issued in the counterpart International patent application PCT/US2012/026698.

* cited by examiner

REFRIGERATED MERCHANDISE DISPLAY SYSTEM

FIELD OF THE INVENTION

The invention relates generally to a refrigerated merchandise display system for storing and dispensing merchandise.

BACKGROUND

The design and construction of commercial refrigerators has remained the same for many years. Generally, commercial refrigerators are large heavy boxes, which have failed to keep up with design trends and consumer expectations. The walls of the commercial refrigerators are typically formed from two thin steel plates with insulating polyurethane foam injected between them. This construction makes the commercial refrigerators heavy, time-consuming to build, and difficult to recycle.

Typically, in convenience stores and grocery stores, customers can only view the product or merchandise within a commercial refrigerator when the customer is standing in front of the refrigerator. Typical refrigerators also position the refrigeration unit at the bottom of the refrigerator. This configuration exposes the refrigeration unit to dirt, debris and other hazards that clog fans and other mechanical parts in the refrigeration unit, which may increase maintenance and replacement costs.

SUMMARY OF THE INVENTION

An object of this invention described herein is to provide a light weight refrigerated merchandise display system. Another object of the invention is to provide visual access of the merchandise within the display system to a customer, from a variety of angles. Another object of the invention is to provide an easily accessible and replaceable refrigeration unit.

In one aspect of the invention, a merchandise display system includes an outer housing, an inner support, a front door assembly, a plurality of windows, a refrigeration unit and a plurality of shelves for supporting merchandise within the display system. The outer housing includes a top wall, a bottom wall, two side walls, and a back wall. In at least one embodiment, the inner support is a tubular steel structure that provides support for the outer housing. In at least one embodiment, the front door assembly is transparent, which allows a customer to view the merchandise within the merchandise display system. The refrigeration unit may be positioned at the top of the merchandise display system and may also be removable. At least one of the plurality of windows may be positioned on each of the side walls of the outer housing. The plurality of windows may provide a customer visual access to a plurality of rows of product within the merchandise display system. The outer housing may be manufactured in a variety of shapes of colors. Each of the colors of the outer housing may be indicative of and promote a type of merchandise or a brand of merchandise.

In another aspect of the invention, a plurality of merchandise display units may be positioned side by side and may share a single refrigeration unit. In this aspect of the invention, each of the plurality of merchandise display units includes an outer housing having a top wall, a bottom wall, two side walls and a back wall. Each of the plurality of merchandise display units further includes an inner support, a front door assembly, a plurality of windows, and a plurality of shelves for supporting merchandise within each of the plurality of merchandise display units. In at least one embodiment, the front door assembly is transparent, which allows a customer to view the merchandise within the merchandise display system. The refrigeration unit may be positioned at the top of the merchandise display system and may also be removable. At least one of the plurality of windows may be positioned on each of the side walls of the outer housing. The plurality of windows may provide a customer visual access to a plurality of rows of product within the merchandise display system. The outer housing may be manufactured in a variety of shapes of colors. Each of the colors of the outer housing may be indicative of and promote a type of merchandise or a brand of merchandise.

DETAILED DESCRIPTION OF THE INVENTION

Figure 1:
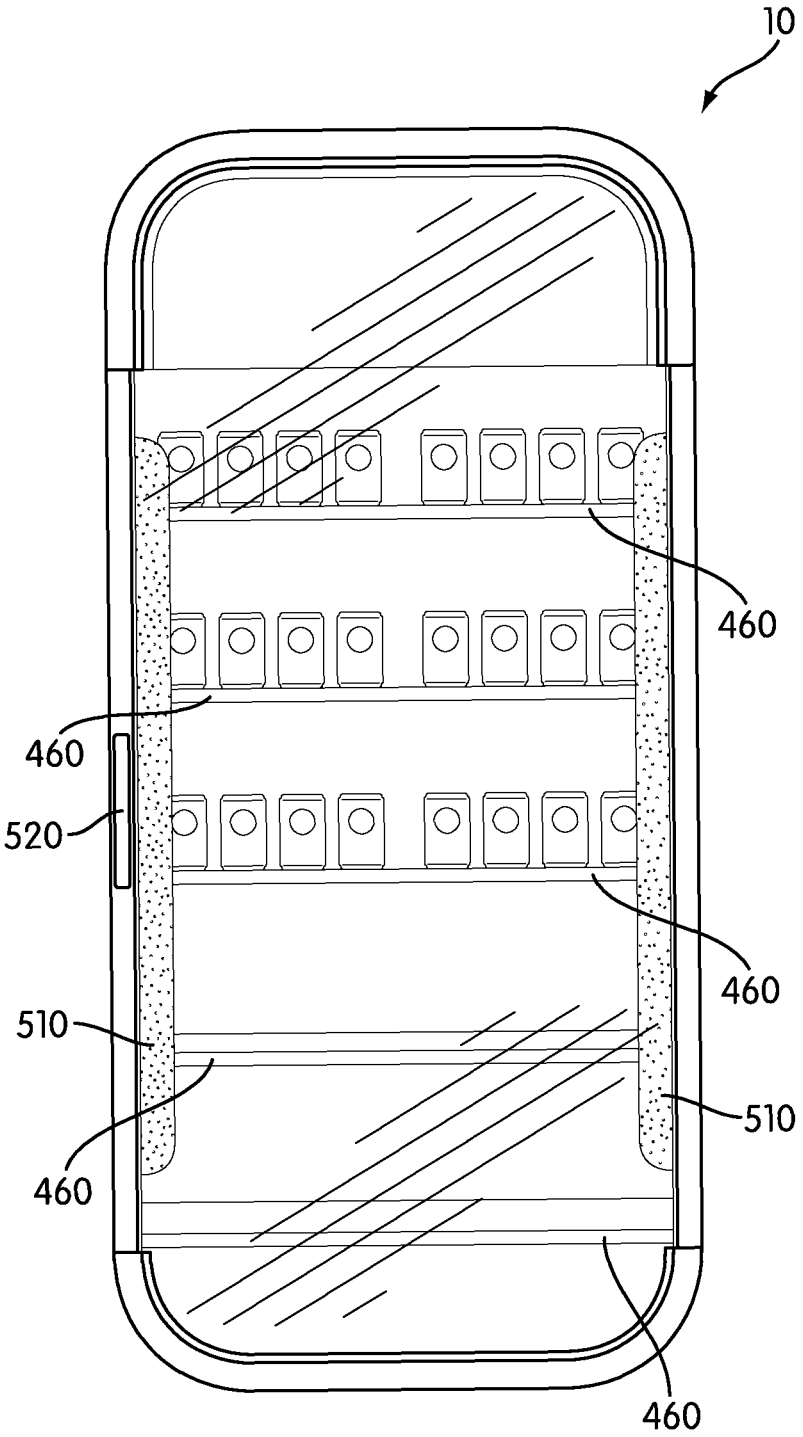
FIG. 1 is a front view of a merchandise display system in accordance with the present invention.
Figure 2:
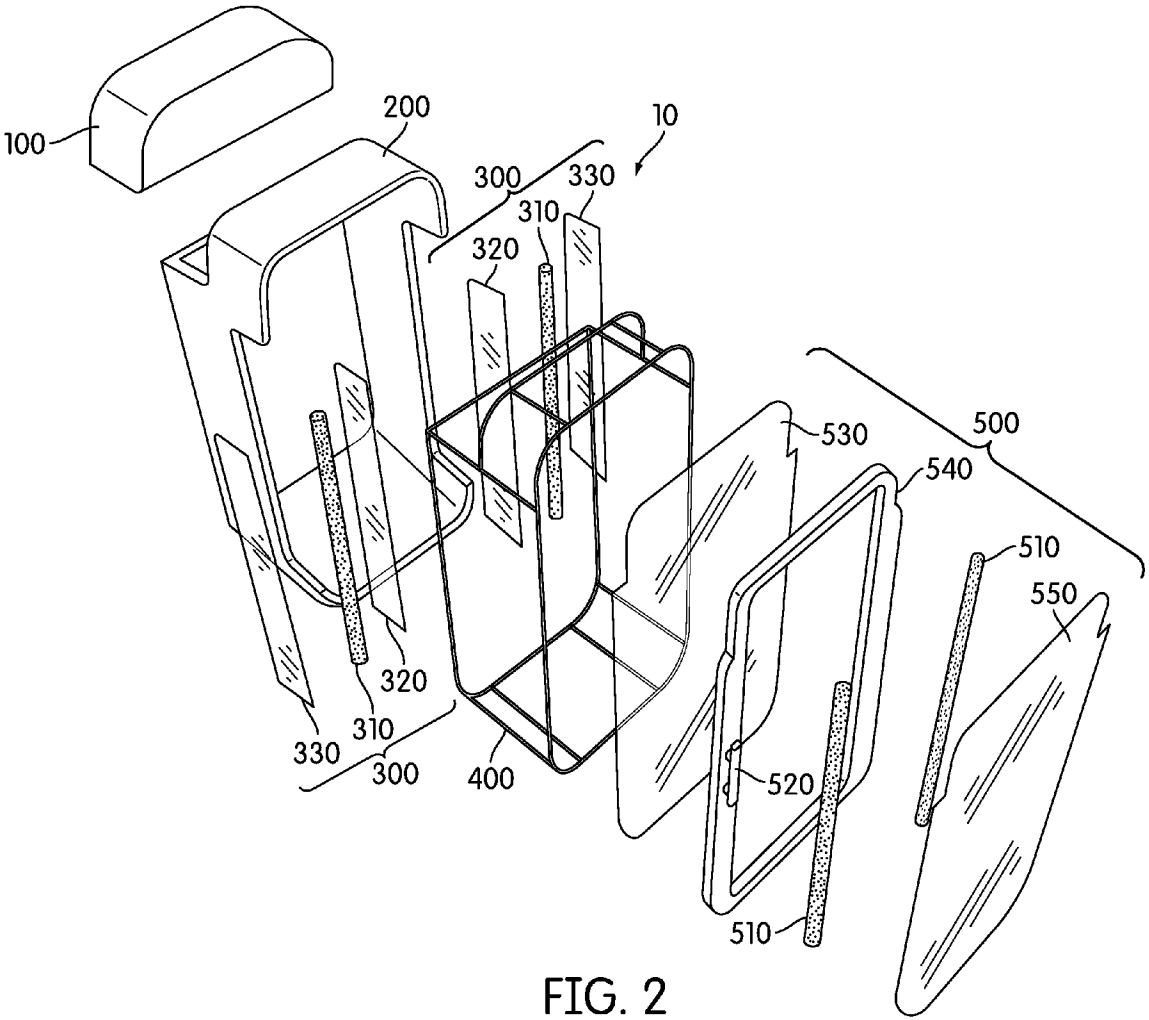
FIG. 2 is an exploded perspective view of exemplary components of the merchandise display system.

Referring to FIG. 1, the merchandise display system of the present invention is indicated generally at 10. FIG. 2 is an exploded view illustrating exemplary components of the merchandise display system 10. As shown in FIG. 2, the merchandise display system 10 is a modular system, which may include a refrigeration unit 100, an outer housing 200, a plurality of windows 300, an inner structure 400, and a front door assembly 500.

Figure 3:
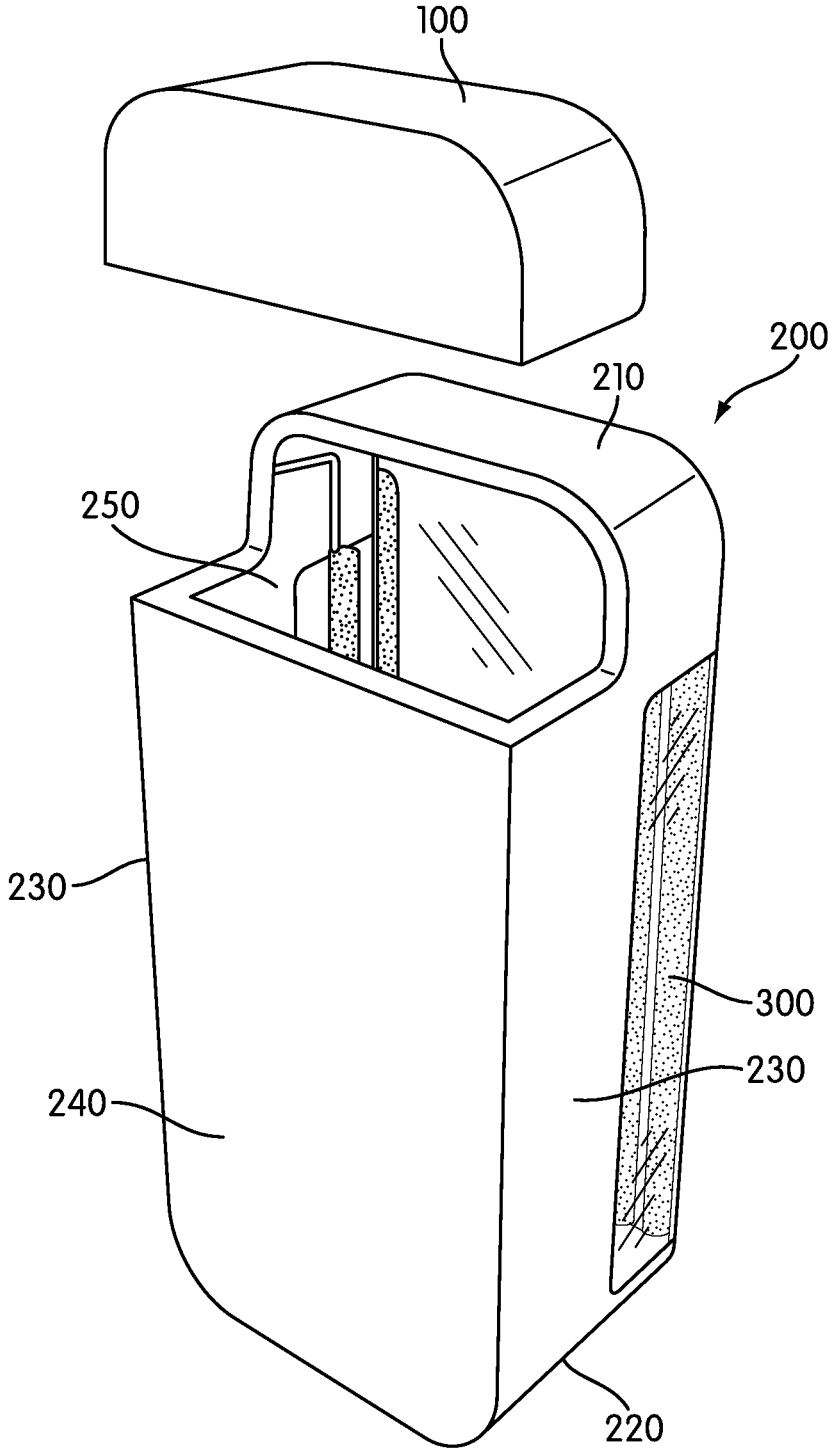
FIG. 3 is a perspective view of the back of the outer housing of the merchandise display system.

As shown in FIG. 3, the outer housing 200 includes a top wall 210, a bottom wall 220, two side walls 230, and a back wall 240. The back wall 240, side walls 230, and top wall 210 define an opening 250 in the outer housing 200. The opening 250 may be configured to receive the refrigeration unit 100.

Figure 4B:
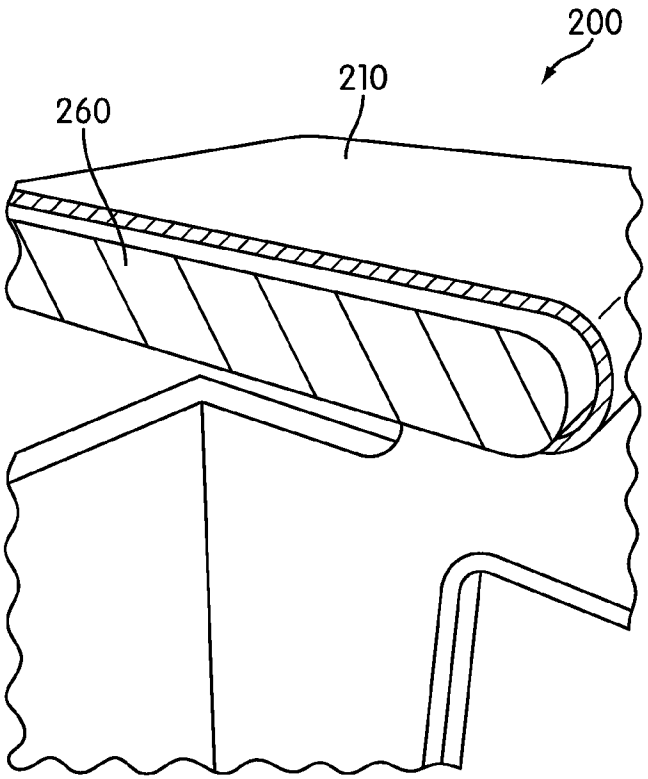
FIGS. 4*a*-4*b* are perspective views of a portion of the outer housing of the merchandise display system.
Figure 4A:
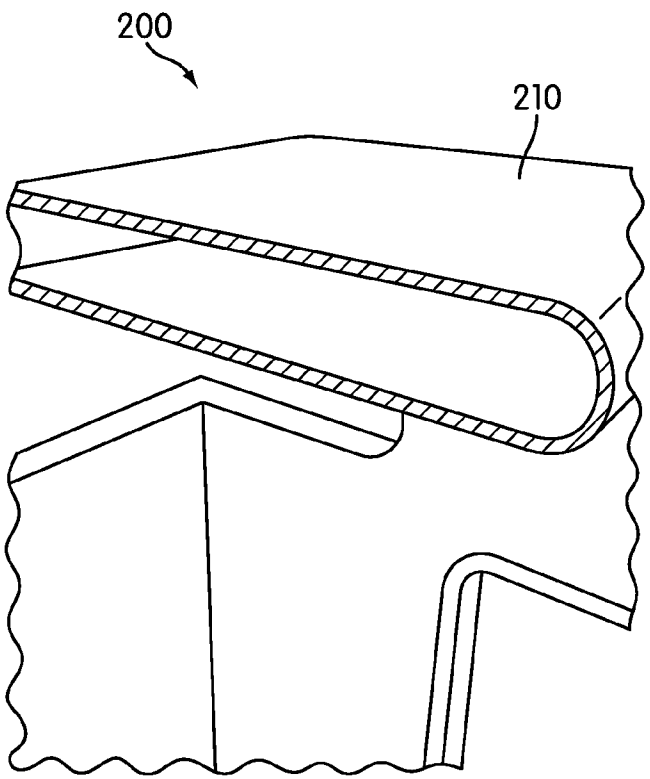

The outer housing 200 may be formed from a single piece of material. The outer housing 200 may be made from any suitable material, such as plastic or metal. In at least one embodiment, the outer housing 200 is a plastic shell, which is manufactured using a rotational molding process. In at least one embodiment, as illustrated in FIGS. 4*a* and 4*b*, the outer housing 200 is a hollow structure filled with a foam-based insulation material 260. The foam-based insulation material 260 may be inserted into the outer housing 200 through an injection molding process. This construction of the outer housing 200 may reduce the weight of the merchandise display system 10, as compared to a typical commercial refrigerator.

The outer housing 200 may be any shape or size suitable for cooling and displaying merchandise. For example, the outer housing 200 may be generally rectangular or box shaped and may include curved or rounded surfaces. The outer housing 200 may be manufactured in a variety of colors. The color of the outer housing 200 may be indicative of a certain brand or type of merchandise and may be used to promote the brand or type of merchandise. For example, blue and red and may be used to promote traditional Pepsi products, white and blue and may be used to promote Diet Pepsi products, green and may be used to promote non-carbonated beverages, and orange and may be used to promote Gatorade products.

Figure 5B:
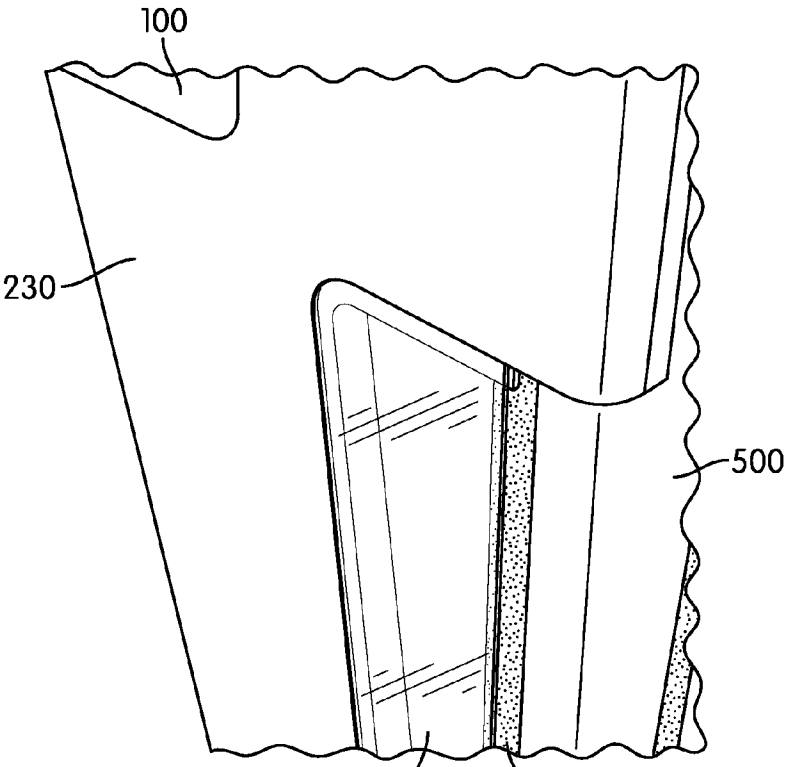
FIGS. 5*a*-5*b* are perspective views of a portion of the side wall of the outer housing of the merchandise display system.
Figure 5A:
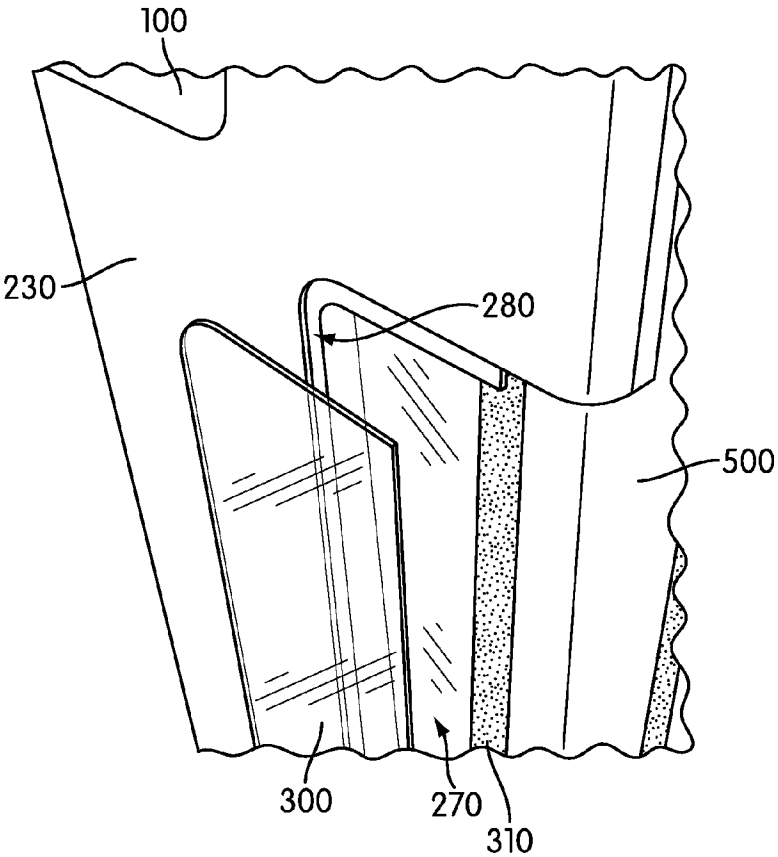

As illustrated in FIGS. 5*a* and 5*b*, the outer housing 200 may include a plurality of windows 300, which allow a customer to view the products being displayed in the merchandise display system 10. In at least one embodiment, the plurality of windows 300 are transparent. The windows 300 may be made of any suitable material, such as glass or plastic. The plurality of windows 300 may be attached to the outer housing 200 in any suitable manner. For example, in one embodiment, the windows 300 may be attached to the outer housing 200 using mechanical methods, such as screws or bolts. In another embodiment, the windows 300 may be attached to the outer housing 200 using an adhesive. In at least one embodiment, the windows 300 are formed from an inner window 320 and an outer window 330, as illustrated in FIG. 2. In this embodiment, the inner window 320 may be attached to an interior surface of the outer housing 200 and the outer window 330 may be attached to the outer surface of the outer housing 200.

Referring back to FIGS. 5*a* and 5*b*, the outer housing 200 may define a plurality of apertures 270 for receiving the plurality of windows 300. In at least one embodiment, the outer housing 200 includes a plurality of window frames, which receive the plurality of windows 300. The window frames may be formed from recessed indentations 280 formed in the outer housing 200. The recessed indentions 280 may surround the windows 300 or may surround only a portion of the windows 300.

The windows 300 may be positioned at any suitable place on the outer housing 200. In at least one embodiment, at least one window 300 is positioned toward the front of each side wall 230 of the outer housing 200, adjacent the front door assembly 500, to allow a customer to view the first few rows of product within the merchandise display system 10 when approaching the merchandise display system 10 from the side. The windows 300 may extend along the entire height of the side wall 230 of the merchandise display system 10 or may extend along a portion of the side wall 230. In at least one embodiment, the merchandise display system 10 includes one or more light bars 310 for illuminating the windows 300. In this embodiment, the light bars 310 may be attached to either the inner surface or the outer surface of the windows 300 or the outer housing 200. Alternatively, if the windows 300 include an inner window 320 and an outer window 330, as illustrated in FIG. 2 the light bars 310 may be positioned between the inner and outer windows.

The outer housing 200 attaches to the inner structure 400 and at least a portion of the outer housing 200 surrounds the inner structure 400. The outer housing 200 may attach to the inner structure 400 in any suitable manner. In at least one embodiment, the inner support 400 interlocks or snap fits into the outer housing 200. Alternatively, the inner structure 400 may attach to the outer housing 200 by mechanical fastening means.

Figure 6:
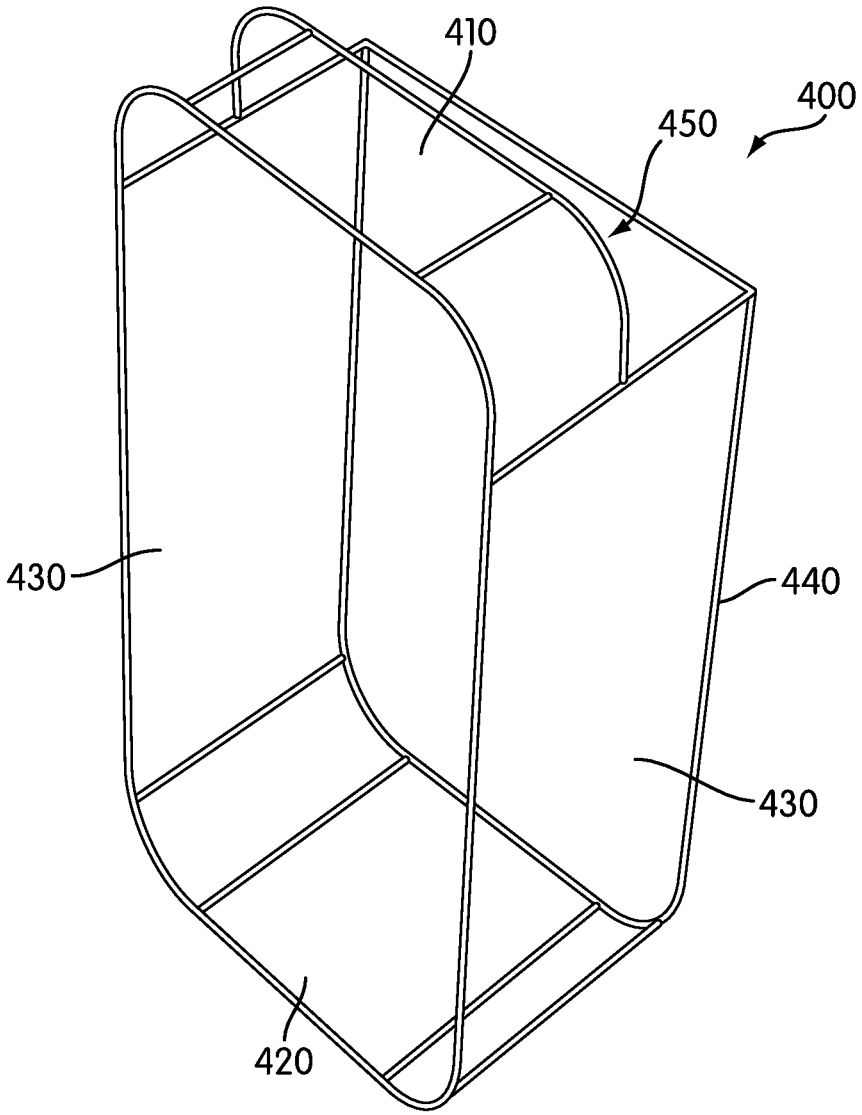
FIG. 6 is a perspective view of the inner structure.

As depicted in FIG. 6, the inner structure 400 includes a top 410, a bottom 420, and two sides 430. The inner structure 400 may include a back 440. The inner structure 400 acts as a chassis or endoskeleton to provide support for the outer housing 200 and generally to the display system 10. The inner structure 400 may be made of any suitable material, such as metal or plastic. In one embodiment, as depicted in FIG. 6, the inner structure 400 is a tubular steel structure. Alternatively, the inner structure 400 may be a solid structure and may include a top wall 410, a bottom wall 420, and two side walls 430. In one embodiment, the inner structure 400 includes a solid back wall 440. The inner structure 400 may also provide support for the refrigeration unit 100. The inner structure 400 may define an opening 450, which corresponds with the opening 250 in the outer housing 200. The opening 250 in the outer housing 200 and opening 450 in the inner structure 400 may be configured to receive the refrigeration unit 100.

As illustrated in FIG. 1, the merchandise display system may include a plurality of shelves 460, which are configured to hold and display merchandise. The plurality of shelves 460 may be attached to and supported by the inner structure 400. The plurality of shelves 460 may be made of any suitable material. For example, the plurality of shelves 460 may be made of plastic or metal. The plurality of shelves 460 may be a solid surface or may include apertures to allow air, liquid and debris to flow through. Any number of shelves 460 is contemplated within the scope of the invention, and may be dependent on the height of the merchandise within the merchandise display system 10.

The merchandise display system 10 includes a refrigeration unit 100. In at least one embodiment, the refrigeration unit 100 is removable from the display system 10, which allows the refrigeration unit to be easily accessed and replaced during maintenance. The refrigeration unit 100 may be positioned at any suitable location within the display system 10. In at least one embodiment, the refrigeration unit 100 is positioned at the top of the display system 10. In this embodiment, the refrigeration unit 100 is placed within the openings 250, 450 of the outer housing 200 and inner support 400. The refrigeration unit 100 may engage with either or both of the outer housing 200 and inner support 400.

The refrigeration unit 100 may include typical refrigeration components such as a compressor, a condenser, an evaporator, a fan, etc. The refrigeration unit 100 may use any suitable type of refrigerant to cool the merchandise display system 10. For example, R134A (tetraflouroethane), CO2 (carbon dioxide), or hydrocarbons may be used. The refrigeration components may be placed within the same enclosure in the refrigeration unit 100 and separated as necessary by insulating material. Alternatively, some of the refrigeration components may be placed in separate enclosures within the refrigeration unit 100.

In one embodiment, the refrigeration unit 100 may be a hybrid convection-conduction refrigeration system. In this embodiment, the refrigeration unit 100 may include a traditional vapor-compression system, which forces cool air from the refrigeration unit 100 downward through the merchandise system 10. The merchandise displayed in the merchandise display system 10 may be cooled through a conduction process where thermal energy is passed from the shelves 460 to the merchandise to cool the merchandise. In this embodiment, heat generated during the cooling process is transferred out of the refrigeration unit 100 and merchandise display system 10.

Referring back to FIG. 2, the front door assembly 500 may include an inner door 530, a door frame 540, and an outer door 550. The front door assembly 500 may be attached to the merchandise display system 10 in any suitable manner. In at least one embodiment, the front door assembly 500 is hingedly attached to the merchandise display system 10. The front door assembly 500 may be attached to the outer housing 200 or the inner structure 400. In at least one embodiment, the front door assembly 500 is transparent to allow a customer to view the product inside the refrigeration display 10.

The front door assembly 500 may open in any suitable manner. For example, the front door assembly 500 may include an axis on one side of the door assembly 500, such that the door assembly 500 pivots around the axis and swings outwardly to allow access to the merchandise display system 10. Alternatively, the door assembly 500 may slide open. The door assembly 500 may include a handle 520 to help facilitate opening the door assembly 500.

As illustrated in FIG. 1, the merchandise display system 10 may include a front lighting system 510. The front lighting system 510 may include a plurality of lights or light bars. In one embodiment, the front lighting system 510 is attached to the outer housing 200. Alternatively, the front lighting system 510 may be attached to the front door assembly 500. In this embodiment, the front lighting system 510 may be attached to either the inner surface or the outer surface of the door assembly 500. In at least one embodiment, the front door assembly 500 includes at least one light bar on each side of the front door assembly 500, adjacent the sidewalk 230. In at least one embodiment, the lighting system 510 may be positioned between the inner door 510 and the outer door 530. The merchandise display system 10 may also include an interior lighting system within the interior portion of display system 10.

In at least one embodiment, one or more of the lighting systems described above may include light emitting diodes ("LEDs"). The lighting systems may include RGB and ultra-bright white LEDs, which may reduce the required amount of electricity needed to illuminate the product or the display system 10 and generate less heat than conventional lighting. In at least one embodiment, each lighting system comprises 50 red, green, and blue ("RGB") LEDs and 20 ultra-bright white LEDs.

Figure 7:
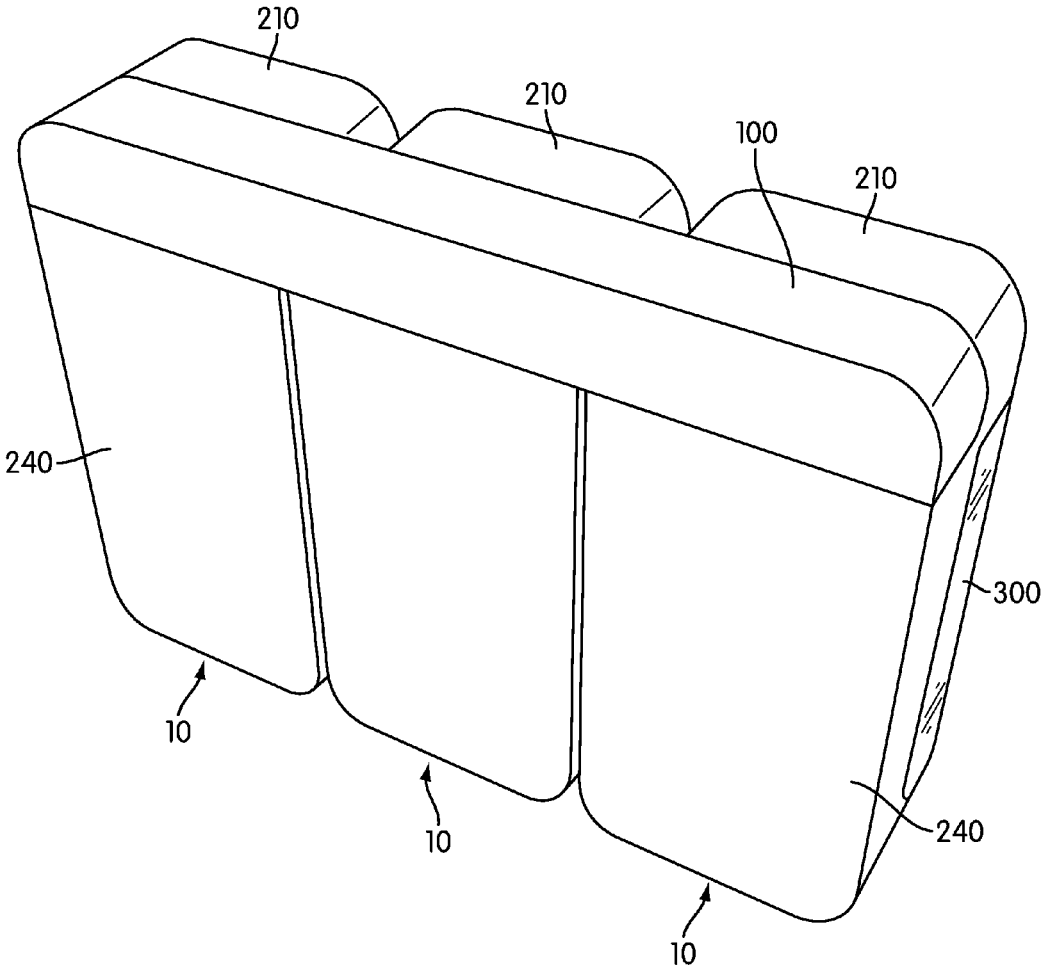
FIG. 7 is a perspective view of the back of an exemplary embodiment of the invention, illustrating a plurality of merchandise display systems in accordance with the present invention.

In one aspect of the invention, as illustrated in FIG. 7, a plurality of merchandise display systems 10 may be positioned side by side and may share a single refrigeration unit 100. In this embodiment, each of the merchandise display systems 10 may include any of the features of the merchandise display systems 10, as described above. For example, each of the merchandise display systems 10 may include an outer housing 200, a plurality of windows 300, an inner structure 400, and a front door assembly 500. In this embodiment, the outer housings 200 of each of the plurality of merchandise display systems 10 may be connected to each other. Alternatively, the plurality of merchandise display systems 10 may be connected together solely by the single refrigeration unit 100.

The merchandise display system 10 may include logos or signs to further promote the brand or type of merchandise within the merchandise display system 10. The logos and signs may be place on any suitable surface of the merchandise display system 10. For example, a sign may be placed on the top wall 210 of the outer housing 200 or logos may be attached to the front door assembly 500 or side walls 230 of the outer housing 200.

While the invention has been described with respect to certain preferred embodiments, as will be appreciated by those skilled in the art, it is to be understood that the invention is capable of numerous changes, modifications and rearrangements and such changes, modifications and rearrangements are intended to be covered by the following claims.

What is claimed is:

1. A merchandise display system comprising:

air outer housing having a top wall, a bottom wall, two side walls and a back wall, the top wall defining a top wall opening, an outer surface of the side walls being exposed to an exterior of the merchandise display system;

an inner support frame that defines an endoskeleton for supporting, the outer housing, the inner support frame including a top tubular steel member, a bottom tubular steel member, a first side tubular steel member, and a second side tubular steel member, the outer housing mounted to and surrounding the inner support frame, the inner support frame forming an inner support opening;

a front, door;

a plurality of windows, at least one of the plurality of windows positioned on each side wall;

a removable refrigeration unit mounted to the top wall of the outer housing and the inner support frame, the refrigeration unit mounted through the top wall opening and the inner support opening, the endoskeleton supporting the refrigeration unit; and a plurality of shelves for supporting merchandise.

2. The merchandise display system of claim 1, wherein the outer housing is a hollow structure filled with insulating material.

3. The merchandise display system of claim 1, wherein the outer housing is manufactured in a plurality of colors.

4. The merchandise display system of claim 3, wherein each of the plurality of colors is indicative of a type of merchandise.

5. The merchandise display system of claim 1, wherein the outer housing defines an opening in the top, side and back walls.

6. The merchandise display system of claim 5, wherein the inner support opening corresponds with the outer housing opening.

7. The merchandise display system of claim 6, wherein the removable refrigeration unit is positioned within the outer housing opening and configured to engage the inner support.

8. The merchandise display system of claim 1, wherein each of the top tubular steel member, bottom tubular steel member, first side tubular steel member, and second side tubular steel member is hollow along its length.

9. The merchandise display system of claim 1, wherein the plurality windows are secured to the outer housing by adhesive.

10. The merchandise display system of claim 1, wherein at least one light bar is adjacent each side wall and attached to the front door.

11. A merchandise display system comprising:

an outer housing having a top wall, a bottom wall, two side walls and a back wall, the outer housing defining an opening within the top, side, and back walls, an outer surface of the side walls being exposed to an exterior of the merchandise display system;

an inner support frame that defines an endoskeleton for supporting the outer housing, the inner support frame including a top tubular member, a bottom tubular member, a first side tubular member, and a second side tubular member, the outer housing mounted to and surrounding the inner support frame, the inner support frame forming an inner support opening;

a front door;

a plurality of windows, wherein at least one of the plurality of windows is positioned on each side wall;

a removable refrigeration unit mounted to the top wall of the outer housing and the inner support frame and positioned within the opening in the outer housing and the inner support opening, the endoskeleton supporting the refrigeration unit; and a plurality of shelves for supporting merchandise, wherein the plurality of shelves are attached to the inner support frame.

12. The merchandise display system of claim 11, wherein the outer housing is a hollow structure filled with insulating material.

13. The merchandise display system of claim 12, wherein each of the top tubular member, bottom tubular member, first side tubular member, and second side tubular member is hollow along its length and made of steel or plastic.

14. The merchandise display system of claim 12, wherein each of the two side walls define a recess and an aperture within the recess.

15. The merchandise display system of claim 14, wherein at least one of the plurality of windows are secured to the recess in each of the two side walls by adhesive.

16. A merchandise display system comprising:

a plurality of display units, each display unit comprising:

an outer housing having a top wall, a bottom wall, two side walls and a back wall, the top wall defining a top wall opening, an outer surface of the side walls being exposed to an exterior of the merchandise display system;

an inner support frame that defines an endoskeleton for supporting the outer housing, the inner support frame including a top tubular steel member, a bottom tubular steel member, a first side tubular steel member, and a second side tubular steel member, the outer housing mounted to and surrounding the inner support frame, the inner support frame forming an inner support opening;

a front door;

a plurality of windows, at least one of the plurality of windows positioned on each side wall; and a plurality of shelves for supporting merchandise, and a removable refrigeration unit mounted to the top wall of the outer housing and the inner support frame, the refrigeration unit mounted through the top wall opening and the inner support opening and configured to cool the plurality of display units, the endoskeleton supporting the refrigeration unit.

17. The merchandise display system of claim 16, wherein each of the plurality of display units include an opening defined in the top wall, side walls, and back wall.

18. The merchandise display system of claim 17, wherein the removable refrigeration unit is positioned within the opening of each of the display units.

19. The merchandise display system of claim 16, wherein each of the side walls defines a recess and an opening within the recess.

20. The merchandise display system of claim 19, wherein the at least one of the plurality of windows are secured to the recess in each of the side walls by adhesive.

* * * * *